US008576255B2

(12) United States Patent
Katayama et al.

(10) Patent No.: US 8,576,255 B2
(45) Date of Patent: Nov. 5, 2013

(54) IMAGE CORRECTION METHOD AND IMAGE DISPLAY DEVICE

(75) Inventors: Yukari Katayama, Chigasaki (JP); Yasuyuki Kudo, Fujisawa (JP); Norio Mamba, Kawasaki (JP); Yoshinori Tanaka, Mobara (JP)

(73) Assignees: Hitachi Displays, Ltd., Chiba (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 839 days.

(21) Appl. No.: 11/951,398

(22) Filed: Dec. 6, 2007

(65) Prior Publication Data

US 2008/0191985 A1 Aug. 14, 2008

(30) Foreign Application Priority Data

Dec. 6, 2006 (JP) ..... 2006-329049

(51) Int. Cl.
*G09G 5/10* (2006.01)

(52) U.S. Cl.
USPC ..... 345/690; 345/214

(58) Field of Classification Search
USPC ..... 345/214, 690
See application file for complete search history.

(56) References Cited

U.S. PATENT DOCUMENTS

| | | | | |
|---|---|---|---|---|
| 6,297,791 | B1 | 10/2001 | Naito et al. | |
| 6,570,611 | B1 | 5/2003 | Satou et al. | |
| 7,129,456 | B2 | 10/2006 | Ioka et al. | |
| 2004/0254716 | A1 * | 12/2004 | Ino et al. | 701/200 |
| 2005/0103976 | A1 * | 5/2005 | Ioka et al. | 250/208.1 |
| 2005/0254102 | A1 * | 11/2005 | Kagami | 358/474 |
| 2005/0275640 | A1 | 12/2005 | Kobayashi et al. | |

FOREIGN PATENT DOCUMENTS

| | | |
|---|---|---|
| JP | 11-316577 | 11/1999 |
| JP | 2003-046809 | 2/2003 |
| JP | 2000-284773 | 10/2003 |
| JP | 2006-084729 | 3/2006 |
| WO | WO 03/071794 | 8/2003 |

* cited by examiner

*Primary Examiner* — Jonathan Boyd
*Assistant Examiner* — Amr Awad
(74) *Attorney, Agent, or Firm* — Antonelli, Terry, Stout & Kraus, LLP.

(57) ABSTRACT

A luminance distribution at the highest gradation level is corrected to a curved plane luminance distribution in such a manner that the maximum gradation input to a display panel shows a curved luminance plane having the highest luminance at the center of the display panel and a lower luminance in the peripheral area of the display panel. The luminance distribution at the minimum gradation is corrected in such a manner that the minimum gradation shows a curved luminance plane having the lowest luminance at the center of the display panel and a higher luminance in the peripheral area of the display panel.

10 Claims, 15 Drawing Sheets

FIG. 3A
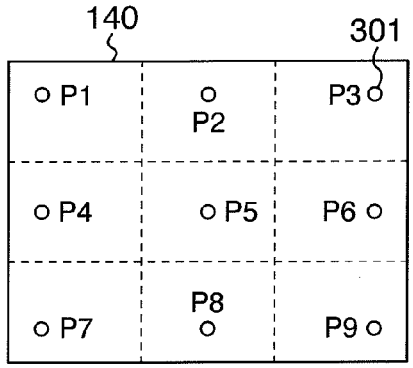
FIG. 3B
REFERENCE POINT LIST
| LUMINANCE (GRADATION LEVEL) | REFERENCE POINT |
|---|---|
| WHITE LUMINANCE (255) | ALL POINTS (P1 TO P9) |
| INTERMEDIATE LUMINANCE (204) | P1,P5,P7 |
| INTERMEDIATE LUMINANCE (128) | P1,P5,P7 |
| INTERMEDIATE LUMINANCE (26) | P1,P5,P7 |
| BLACK LUMINANCE (0) | ALL POINTS (P1 TO P9) |
FIG. 4
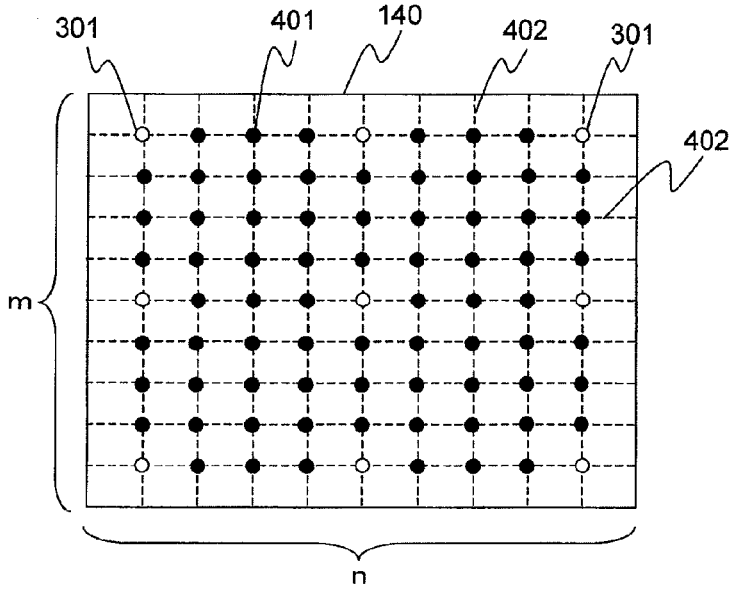

IMAGE CORRECTION METHOD AND IMAGE DISPLAY DEVICE

INCORPORATION BY REFERENCE

The present application claims priority from Japanese application serial No. 2006-329049 filed on Dec. 6, 2006, the content of which is hereby incorporated by reference into this application.

BACKGROUND OF THE INVENTION

The present invention relates to an image correction method of correcting a display luminance of a display panel and an image display device.

In a display device using a liquid crystal display panel or the like, even if an image is displayed on the whole screen at the same luminance, there appears conventionally a variation (in-plane variation) phenomenon in a luminance at each position in the screen. In order to correct this in-plane variation, there has been proposed a method by which the screen plane is divided into a plurality of areas, a luminance distribution in the areas is measured, correction values calculated from the measured luminance distribution are supplied to an image processing circuit of the display device, and when an image is displayed, a luminance distribution at respective pixels in each area is generated by an interpolation function by utilizing the correction values to maintain uniformity of luminances of the display device by using the interpolated values.

This method includes a method using analog signals as disclosed in U.S. Pat. No. 6,570,611 (JP-A-2000-284773) and a method using digital signal processing as disclosed U.S. Patent Publication No. 2005/0275640 (JP-A-2003-46809). In addition, U.S. Pat. No. 6,297,791 (JP-A-11-316577) and JP-A-2006-84729 propose a method of measuring luminances and generating correction data by measuring points on a screen with a luminance sensor.

SUMMARY OF THE INVENTION

According to the above-described techniques, a luminance at the highest gradation (tonal) level is set to the lowest luminance at the highest gradation level in a panel, because the luminance at the highest level can only be adjusted only by lowering it. Similarly, a luminance at the lowest gradation (tonal) level is set to the highest luminance at the lowest gradation level in the panel, because the luminance at the lowest level can only be adjusted only by raising it. This adjustment is, however, associated with a problem that contrast is degraded. The contrast is defined as a ratio between highest and lowest luminances at the center of a panel.

An object of the present invention is to provide an image correction method and an image display device capable of maintaining a good contrast and obtaining a smooth and high display quality without stripe noise and color unevenness by correction data, on a panel after image correction.

The present invention is characterized in that a luminance is corrected to have a curved plane taking the highest luminance at the highest gradation level at the center of a panel and lowering toward the edge of the panel, and in that a luminance is corrected to have a curved plane taking the lowest luminance at the lowest gradation level at the center of the panel and raising toward the edge of the panel.

According to the present invention, it is possible to maintain a good contrast and obtain a smooth and high display quality without stripe noise and color unevenness by correction data, on a panel after image correction.

Other objects, features and advantages of the invention will become apparent from the following description of the embodiments of the invention taken in conjunction with the accompanying drawings.

BRIEF DESCRIPTION OF THE DRAWINGS

FIGS. 3A and 3B show reference points of a liquid crystal display panel and a reference point list.

FIG. 4 is a diagram showing reference points of a liquid crystal display panel.

DESCRIPTION OF THE EMBODIMENTS

Figure 1:
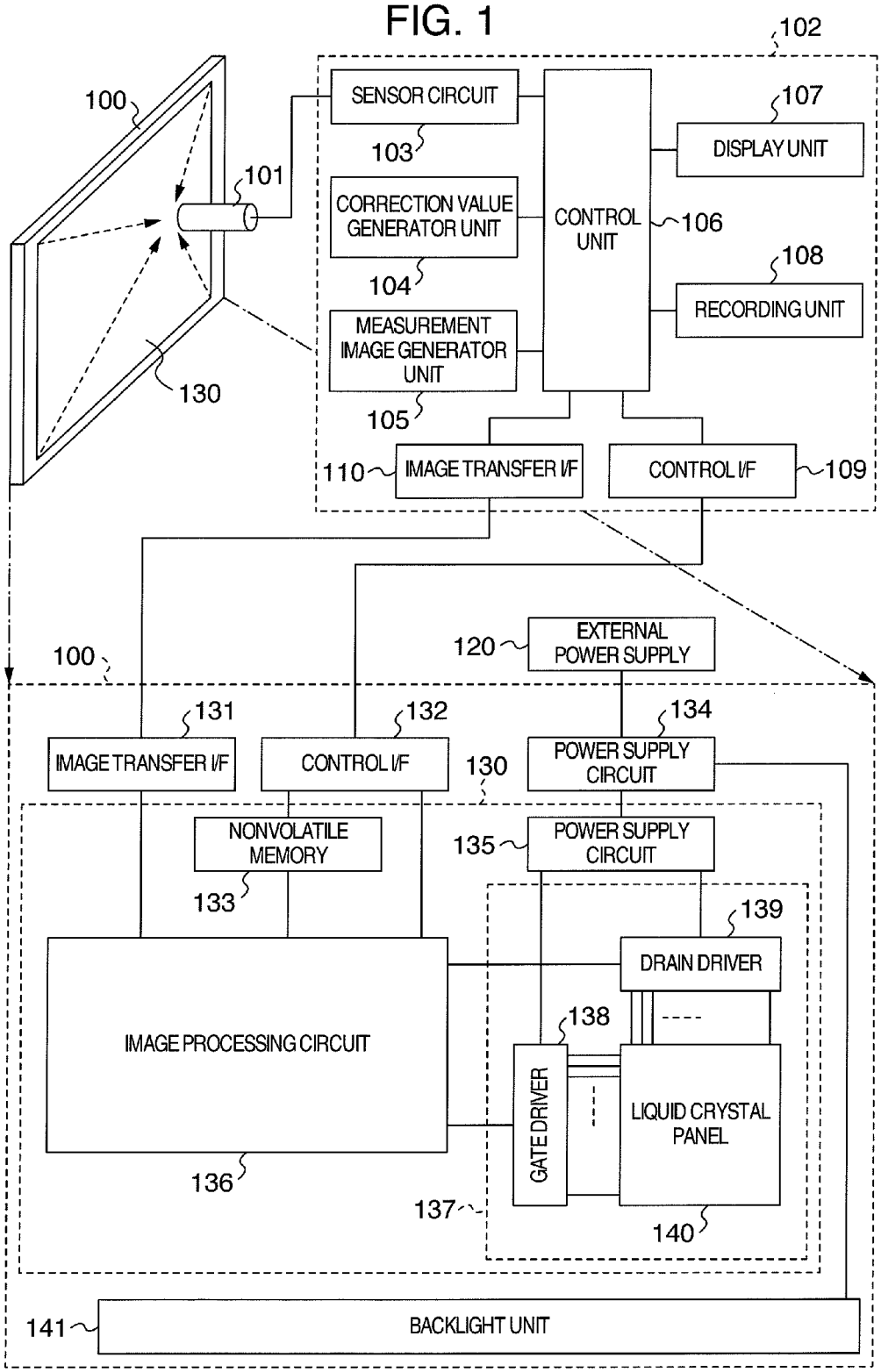
FIG. 1 is a diagram showing the configuration of an image correction system according to the present invention.

FIG. 1 is a diagram showing the structure of an image correction system of the present invention. Referring to FIG. 1, a liquid crystal display device 100 is a display device to be inspected, and is constituted of a liquid crystal panel unit 130, a backlight unit 141, an image transfer I/F 131, a control I/F 132 and a power supply circuit 134.

The liquid crystal panel unit 130 is constituted of a liquid crystal panel 140 for displaying an image and its control system. The image transfer I/F 131 is I/F for inputting an image signal from an external. The control I/F 132 is used for input/output of a control signal which controls the operation of the liquid crystal panel unit 130. The backlight unit 141 is used as a light source which emits light transmitting through the liquid crystal panel 140. The power supply circuit 134 conducts voltage conversion of a power from an external power source 120 to supply voltage to each internal constituent component.

The internal structure of the liquid crystal panel unit 130 will be described. A nonvolatile memory 133 is used for storing data to be utilized by an image processing circuit 136. The image processing circuit 136 processes an image signal input via the image transfer I/F 131, and transmits a display signal to a display unit 137. The image processing circuit 136 executes an in-plane variation correction process.

The display unit 137 is constituted of a gate driver 138, a drain driver 139 and the liquid crystal panel 140. The gate driver 138 and drain driver 139 are each made of an analog circuit such as an operational amplifier for driving the liquid crystal panel 140.

In this embodiment, the liquid crystal panel 140 uses active matrix TFT liquid. The display unit 137 is not limited only to a liquid crystal display unit, but other devices such as an organic EL device may be used. In this case, the backlight unit 141 becomes unnecessary depending upon the device used.

A power supply circuit 135 generates power for driving each circuit in the liquid crystal panel unit 130. The external power source 120 is a general external power source for supplying power to the liquid crystal display device 100. Depending upon situations, power may be supplied directly to the liquid crystal display device 100 from a general power line via a plug.

A measuring apparatus 102 is an apparatus for measuring luminances of the liquid crystal display device 100, controls to display a measurement image on the liquid crystal display device 100 and generates in-plane variation correction values from measurement results of the measurement image.

The measuring apparatus 102 is constituted of: an image sensor 101 for measuring luminances of the liquid crystal panel 140; a sensor circuit 103; a correction value generator unit 104 for generating correction values from measured luminances; a measurement image generator unit 105 for generating a measurement image to be displayed on the liquid crystal panel 140; a display unit 107 for displaying information for checking a measurement state; a recording unit 108 for recording measured data and the like; an image transfer I/F 110, a control I/F 109 and a control unit 106 for controlling these constituent components. The measurement image generator unit 105 may use an image signal generator.

Figure 2:
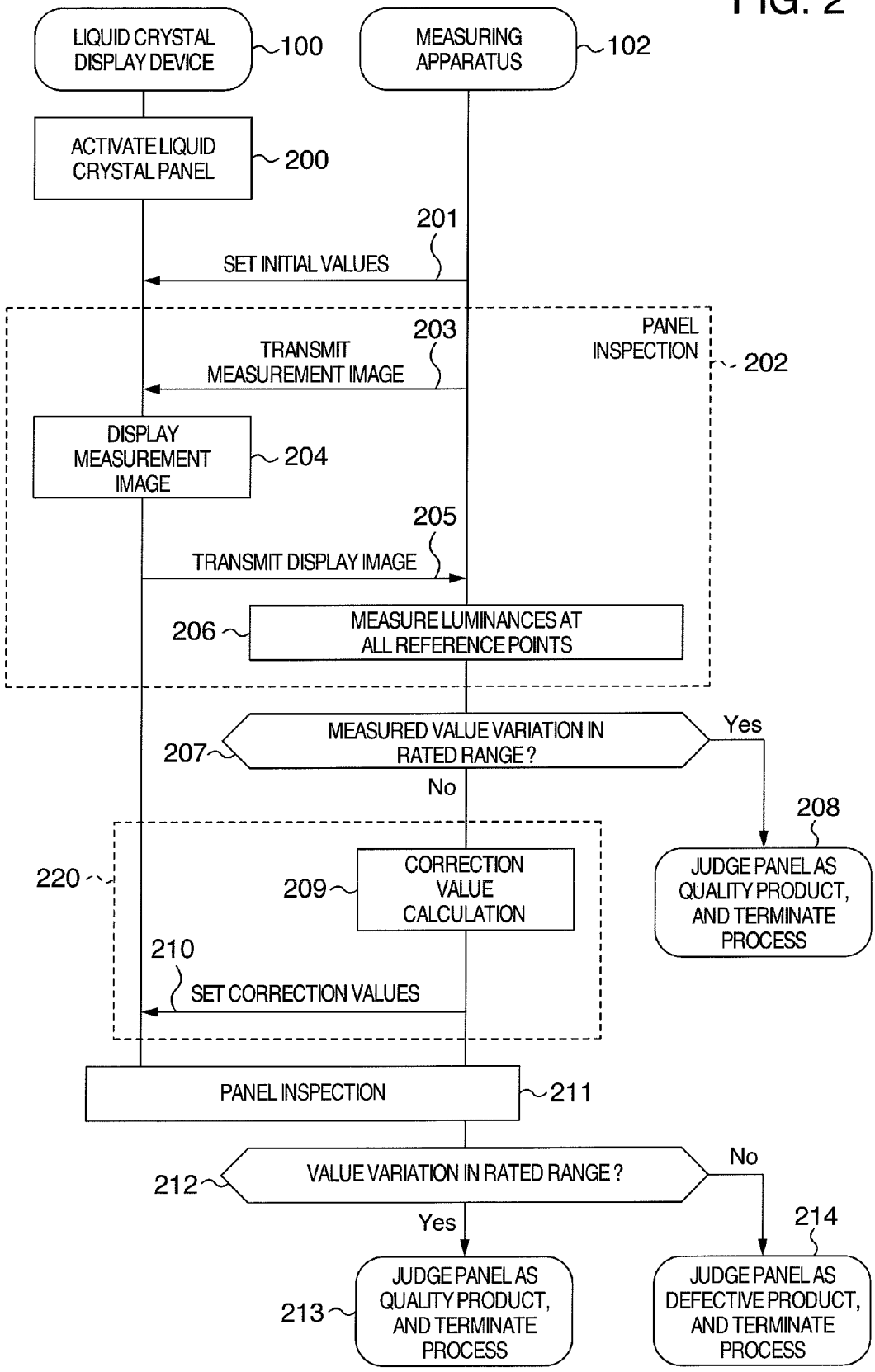
FIG. 2 is a flow chart illustrating inspection of a liquid crystal display device.

FIG. 2 is a flow chart illustrating an inspection process to be executed by the control unit 106 of the measuring apparatus 102 to inspect the liquid crystal display device 100. Referring to FIG. 2, first the liquid crystal display device 100 to be inspected is powered on to activate the liquid display panel 140 (Step 200). Next, the measuring apparatus 102 sets initial values to the liquid crystal display device 100 via the control I/F 109 (Step 201). Next, panel inspection is performed at 202.

In the panel inspection at 202, the measuring apparatus 102 transmits a measurement image to the liquid crystal display device 100 (Step 203), and the liquid crystal display device 100 displays the measurement image (Step 204). The displayed image is picked up with the image sensor 101 and transmitted to the measuring apparatus 102 (Step 205).

Next, luminances of the picked-up image are measured at all predetermined reference points (Step 206). In this measurement, a lattice pattern may be displayed on the liquid crystal panel 140 to facilitate judgment of the reference points. Different reference points may be used depending upon the luminances to be measured.

It is judged from the measurement results of luminances during the panel inspection at 202 whether a variation (unevenness) in luminances at respective reference points is in a rated (predetermined) range (Step 207). If a luminance variation (unevenness) is in the rated range, it is judged that the panel is a quality product, and the process is terminated (Step 208). If the luminance variation is not in the rated range, a correction process at 220 is executed.

For judgment whether the luminance variation is in the rated range, for example, as shown in the following formula (1), it is judged that the luminance variation is in the rated range, if a percent value of a luminance uniformity degree Buni(g) at a gradation level g, which percent value is the lowest luminance min(g) at the gradation level g divided by the highest luminance max(g) at the gradation level g, is not smaller than a predetermined value, e.g., not smaller than 80%.

$$Buni(g) = \frac{\min(g)}{\max(g)} \tag{1}$$

Next, the contents of the correction process at 220 will be described. In the correction process at 220, correction values are calculated from the luminance measurement results at Step 206 (Step 209). The correction values are set to the liquid crystal display device 100 (Step 210).

Panel inspection at 211 similar to the panel inspection at 202 is executed to judge whether correction of the liquid crystal display device 100 set with the correction values functions effectively and whether the luminance variation is in the rated range (Step 222). If the luminance variation is in the rated range, the panel is judged as a quality product to terminate the process (Step 213). If the luminance variation cannot be corrected sufficiently, the panel is judged as a defective product to terminate the process (Step 214).

FIGS. 3A and 3B show reference points of the liquid crystal panel 140 and a reference point list. As shown in FIG. 3A, for inspection, the liquid crystal panel 140 is divided into nine areas P1 to P9, and a reference point 301 is set to each divided area. FIG. 3B shows a list of reference points and their luminances. As shown in this list, a white luminance and a black luminance are measured at all points (9 points), and an intermediate luminance may be measured only at points P1, P5 and P7 where a variation is likely to occur.

FIG. 4 is a diagram showing reference points of the liquid crystal panel 140 having horizontal n pixels×vertical m pixels. Referring to FIG. 4, a cross point of lattice lines 402 represented by a white circle 301 is used as a reference point. Luminances are measured at all reference points to judge whether a variation in luminances at the reference points is in the rated range. Next, if the luminance variation is not in the rated range, luminances at detail reference points represented by black circles 401 are calculated from the luminances of the reference points by interpolation calculations.

Figure 5:
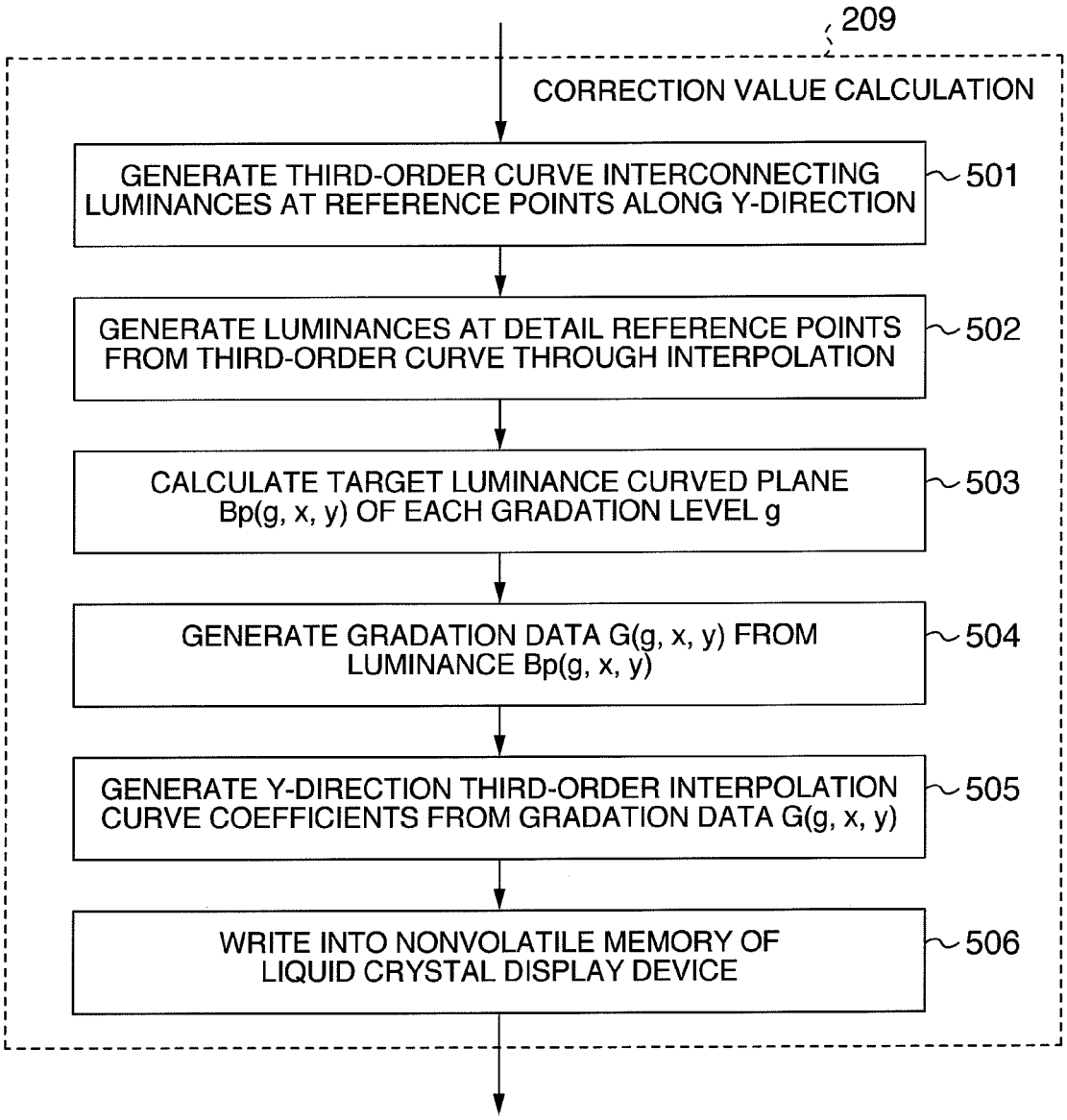
FIG. 5 is a flow chart illustrating correction value calculation to be executed by a measuring apparatus.

FIG. 5 is a flow chart illustrating the details of the correction value calculation at 209 shown in FIG. 2. Referring to FIG. 5, first a third-order curve interconnecting the luminances at the reference points along a Y-direction is generated (Step 501). In generating the third-order curve, a method may be used by which third-order curves each interconnecting two reference points are consecutively coupled. However, a third-order Spline curve is adopted in order to couple two adjacent third-order curves smoothly at the reference point. The third-order Spline curve can realize interpolation by a smooth curve, under the condition that not only the Spline curve passes the luminance at each reference point but also first- and second-order differentiations of the luminance become equal.

Figure 6:
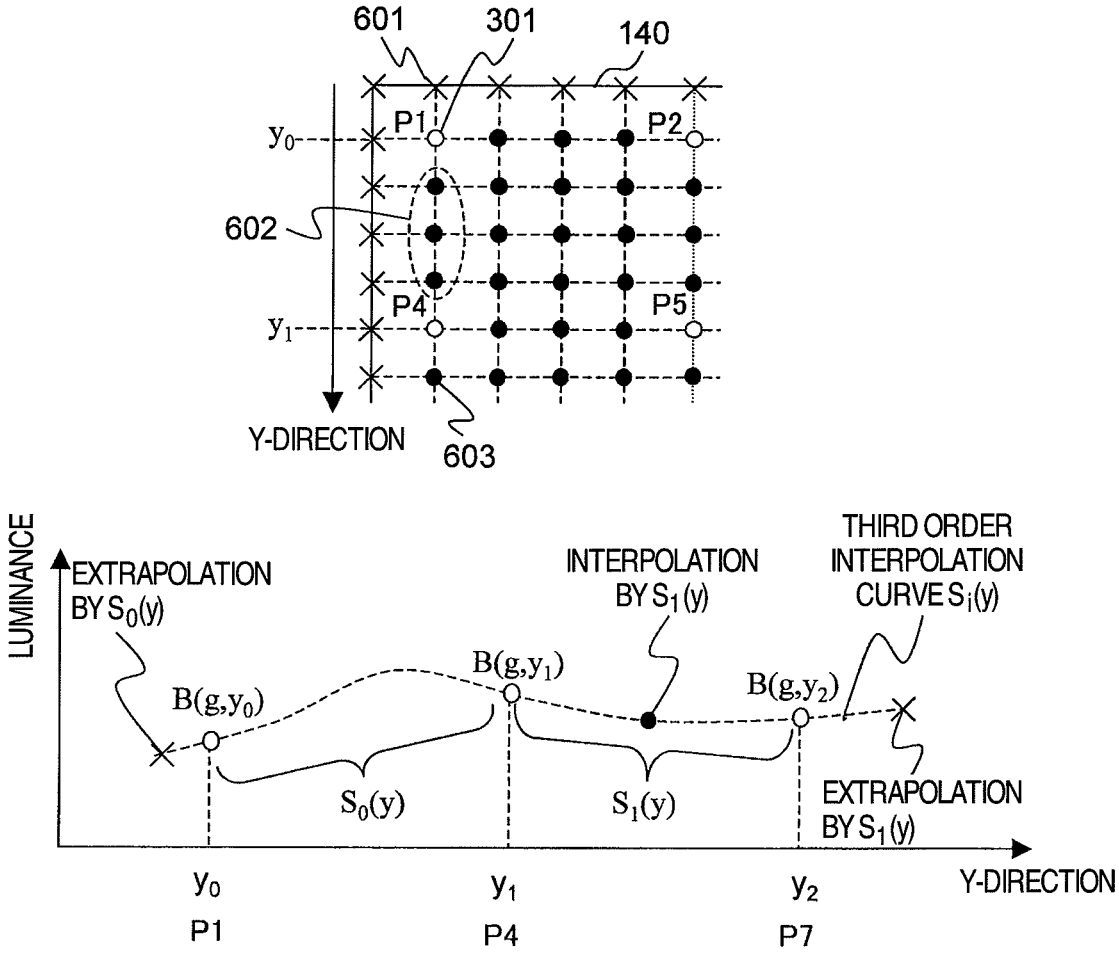
FIG. 6 illustrates a luminance interpolation process for correction value calculation.

FIG. 6 illustrates an interpolation method using a Spline line. The y-coordinates of the reference points in the Y-direction including the reference point 301 are defined as y0, y1, . . . , yp, and the luminances at the coordinates are defined as B(g, y0), B(g, y1), ... , B(g, yp). In this embodiment, p=2. Defining an interpolation formula for obtaining B(g, y) where yi<y<yi+1 is defined as Si(y), Si(y) is expressed by the following formula (2). In this embodiment i=0 or 1.

$$S_i(y)=a_i+b_i(y-y_i)+c_i(y-y_i)^2+d_i(y-y_i)^3 \tag{2}$$

The condition of smoothly coupling the interpolation curve Si+1(y) at the section of yi+1<y<yi+2 at the y-coordinate yi+1 is expressed by the following formula (3).

$$S_i(y_i)=B(g,y_i)$$

$$S_i(y_{i+1})=S_{i+1}(y_{i+1})=B(g,y_{i+1})$$

$$S'_i(y_{i+1})=S'_{i+1}(y_{i+1})$$

$$S''_i(y_{i+1})=S''_{i+1}(y_{i+1}) \tag{3}$$

The boundary condition at opposite ends is set so that secondary differentiation becomes 0, because of maintaining a slope of the interpolation curve between y0 and yp when the condition of obtaining the curve is set to the following formula (4) and performing extrapolation by using this function.

$$S''_0(y_0)=S''_{p-1}(y_p)=0 \tag{4}$$

The following relation (5) is established by defining as yp−yi=1 and calculating coefficients ai, bi, ci and di of the function Si(y) from the above formulae (3) and (4). By solving the formula (5), the coefficients ai, bi, ci and di of Si(y) shown in the formula (2) are determined.

$$a_i = B(g, y_i) \tag{5}$$

$$b_i = a_{i+1} - a_i - \frac{c_{i+1} + 2c_i}{3}$$

$$d_i = \frac{(c_{i+1} - c_i)}{3}$$

$$\begin{pmatrix} 1 & 0 & 0 & 0 & \cdots & 0 & 0 & 0 \\ 1 & 4 & 1 & 0 & \cdots & 0 & 0 & 0 \\ 0 & 1 & 4 & 1 & \cdots & 0 & 0 & 0 \\ 0 & 0 & 1 & 4 & \cdots & 0 & 0 & 0 \\ \vdots & \vdots & \vdots & \vdots & \iddots & \vdots & \vdots & \vdots \\ 0 & 0 & 0 & 0 & \cdots & 4 & 1 & 0 \\ 0 & 0 & 0 & 0 & \cdots & 1 & 4 & 1 \\ 0 & 0 & 0 & 0 & \cdots & 0 & 0 & 1 \end{pmatrix} \begin{pmatrix} c_0 \\ c_1 \\ c_2 \\ c_3 \\ \vdots \\ c_{p-2} \\ c_{p-1} \\ c_p \end{pmatrix} = \begin{pmatrix} 0 \\ 3(a_2 - 2a_1 + a_0) \\ 3(a_3 - 2a_2 + a_1) \\ 3(a_4 - 2a_3 + a_2) \\ \vdots \\ 3(a_{p-1} - 2a_{p-2} + a_{p-3}) \\ 3(a_p - a_{p-1} + a_{p-2}) \\ 0 \end{pmatrix}$$

Next, by using Si(y) shown in the formula (2), the luminances at the detail reference points 601, 602 and 603 shown in FIG. 6 are generated by interpolation as shown in FIG. 5 (Step 502). In this interpolation method, a value of the point at opposite ends of the panel, e.g., of the detail reference point 601, is obtained by extrapolation using $S_0(y)$. Values of the detail reference points 602 and 603 between already measured reference points are obtained by interpolation. Luminances at reference points still not measured are calculated by interpolation also for the X-coordinates to obtain luminances B (g, x, y) in the XY coordinate system. Next, a target curved luminance plane Bp(g, x, y) at each gradation level g is calculated as shown in FIG. 5 (Step 503).

In the following, the operation at Step 503 shown in FIG. 5 will be described. It is assumed for example that the luminance distribution at the highest gradation level $g_{max}$ measured at Step 206 shown in FIG. 2 is a distribution shown in FIG. 12A.

In FIGS. 12A and 12B and FIGS. 14A and 14B, X- and Y-axes represent the horizontal and vertical directions of the panel, respectively, and (x, y)=(0, 0) represents the center of the panel. A Z-axis represents a luminance of the panel.

Figure 12A:
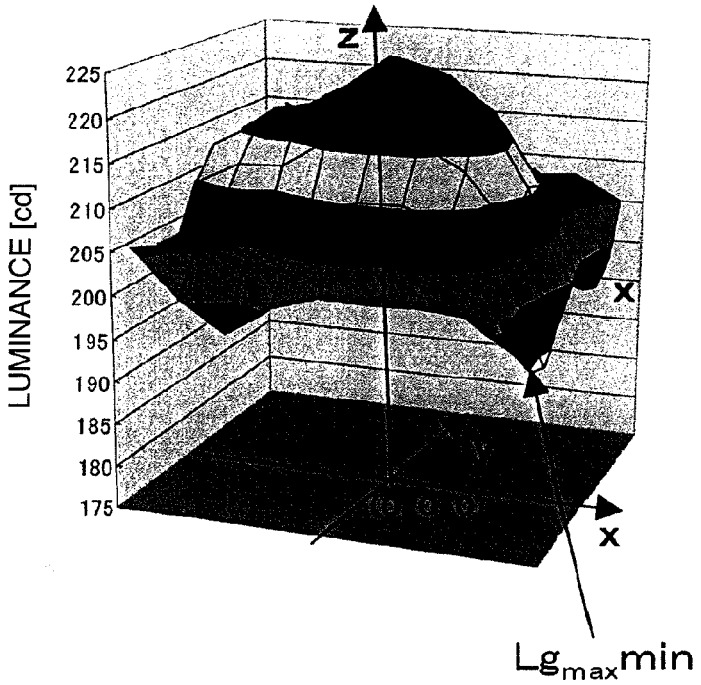
FIGS. 12A and 12B are three-dimensional diagrams showing luminance distributions before and after correction at the highest gradation level of a liquid crystal display panel.

Representing a minimum value of the luminance shown in FIG. 12A by $Lg_{max}$min, a target curved luminance plane $Bp(g_{max}, x, y)$ having the highest luminance at the center of the panel and a luminance $Lg_{max}$min at the periphery can be obtained, for example, by the following formula (6).

$$Bp(g_{max},x,y)=Lg_{max}\min(1+Ag_{max}\times\mathrm{COS}(\pi x/(2x_{max}))\ \mathrm{COS}(\pi y/(2y_{max}))) \tag{6}$$

$Ag_{max}$ in the formula (6) is a constant and has restrictions shown in the following formulae (7).

$$Ag_{max} \geq 0 \tag{7}$$

$$Ag_{max} \leq \frac{1}{Buni(g_{max})} - 1$$

where $X_{max}$ and $Y_{max}$ are maximum values at positions x and y, respectively.

From the conditions shown in the formulae (7), a ratio between minimum and maximum target luminances at the highest gradation level is not smaller than Buni($g_{max}$) and not larger than 1. According to the current specification, Buni ($g_{max}$)=0.85.

Figure 12B:
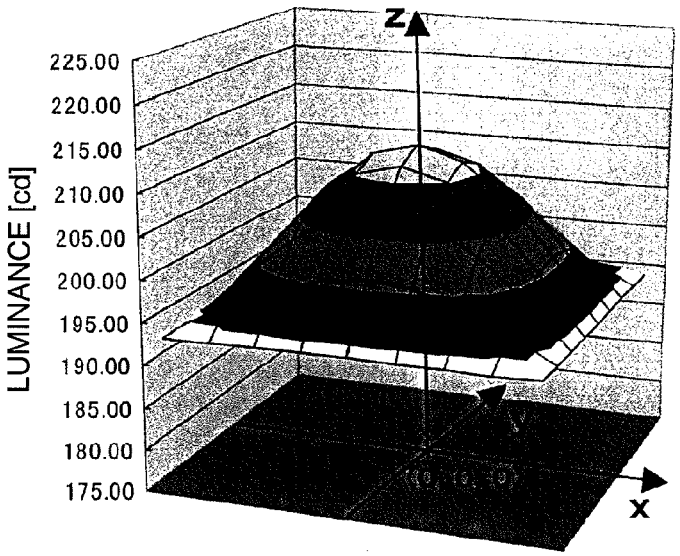

A curved luminance plane obtained from the formula (6) is shown in FIG. 12B. A method of obtaining the target curved luminance plane having the highest luminance at the center of the panel and a lower luminance at the periphery of the panel is not limited to the formula (6).

Figure 14A:
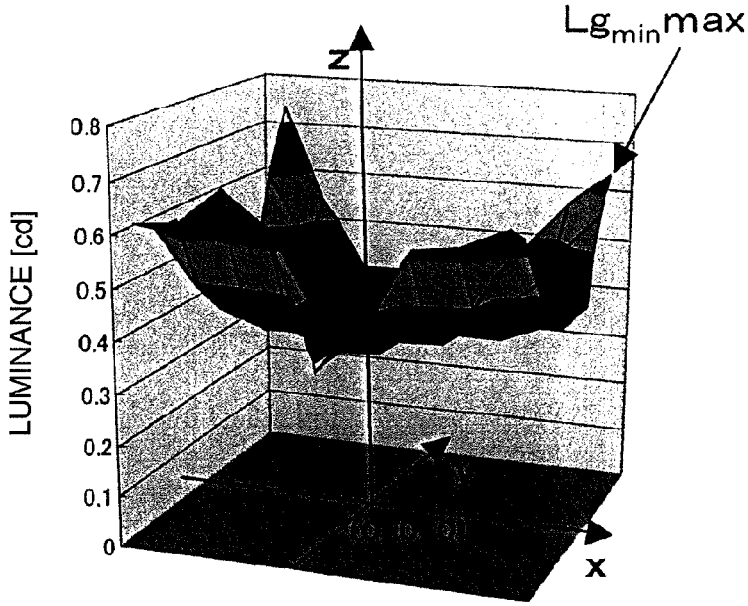
FIGS. 14A and 14B are three-dimensional diagrams showing luminance distributions before and after correction at the lowest gradation level of a liquid crystal display panel.

Next, it is assumed that luminances at the lowest gradation level $g_{min}$ take values shown in FIG. 14A. Representing a maximum value of the luminance shown in FIG. 14A by $Lg_{min}$max, a target curved luminance plane $Bp(g_{min}, x, y)$ having the lowest luminance at the center and a luminance $Lg_{min}$max at the periphery can be obtained, for example, by the following formula (8).

$$Bp(g_{min},x,y)=Lg_{min}\min(1-Ag_{min}\times\mathrm{COS}(\pi x/(2x_{max}))\ \mathrm{COS}(\pi y/(2y_{max}))) \tag{8}$$

$Ag_{min}$ in the formula (8) is a constant and has restrictions shown in the following formulae (9).

$$Ag_{min}\geq 0$$

$$Ag_{min}\leq 1-Buni(g_{min}) \tag{9}$$

where $X_{max}$ and $Y_{max}$ are maximum values at positions x and y, respectively.

From the conditions shown in the formulae (9), a ratio between minimum and maximum target luminances at the highest gradation level is not smaller than Buni($g_{min}$) and not larger than 1. According to the current specification, Buni ($g_{min}$)=0.6.

Figure 14B:
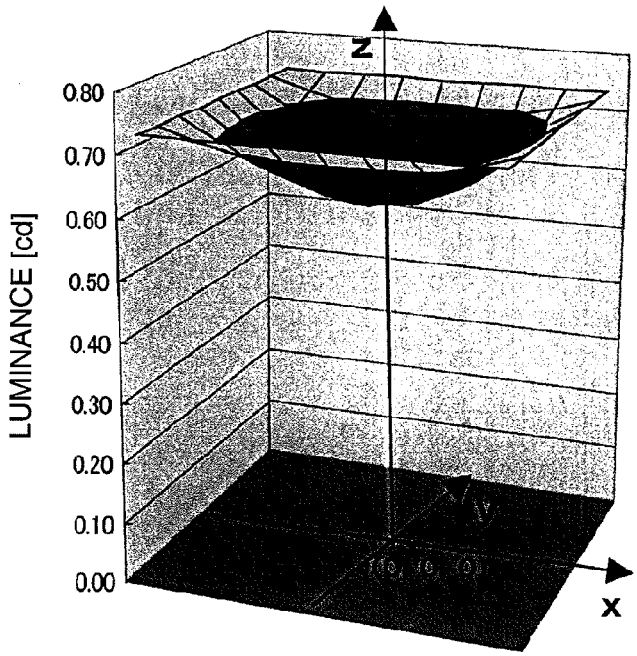

A curved luminance plane obtained from the formula (8) is shown in FIG. 14B. A method of obtaining the target curved luminance plane having the lowest luminance at the center of the panel and a higher luminance at the periphery of the panel is not limited to the formula (8).

By determining the target curved luminance planes at the highest gradation level $g_{max}$ and lowest gradation level $g_{min}$ in the manner described above, a contrast takes a value of $Bp(g_{max}, 0, 0)/Bp(g_{min}, 0, 0)$ and is improved considerably as compared to $Lg_{max}min/Lg_{min}max$ of planar correction. Since the luminance after correction changes smoothly, it is possible to prevent a defect such as stripes on the screen after correction.

Figure 13:
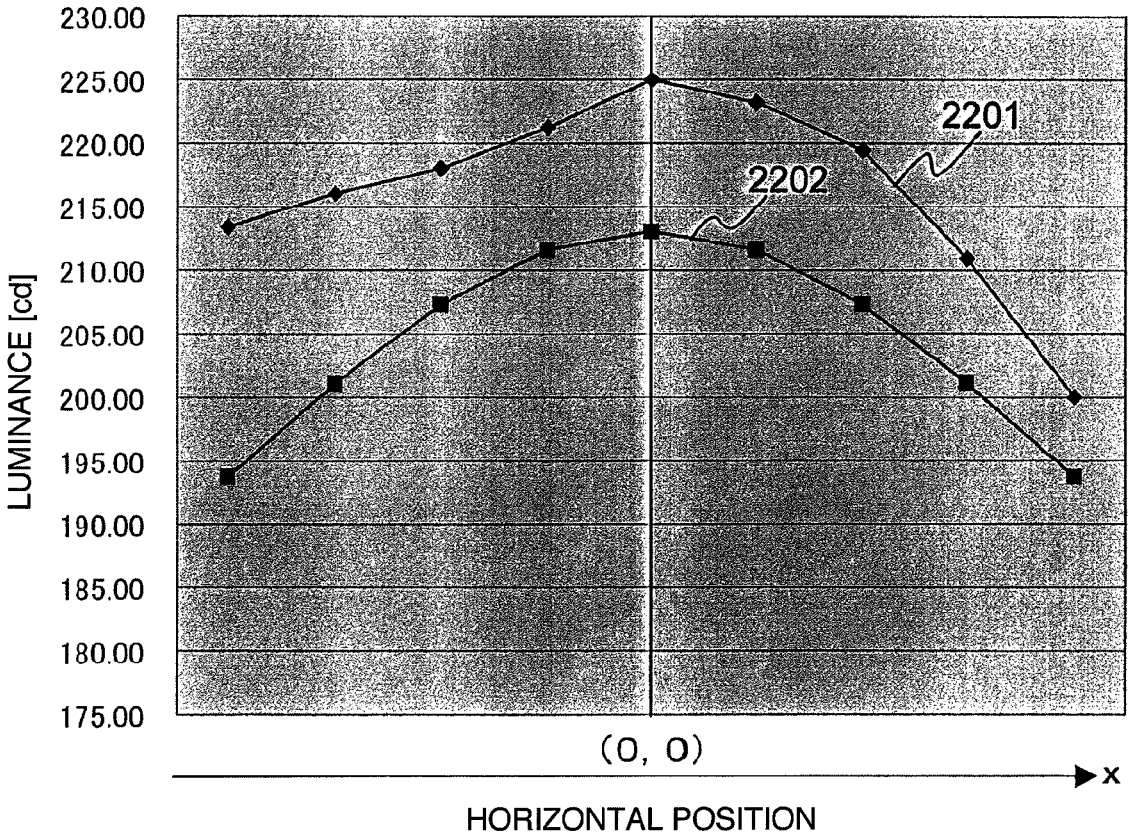
FIG. 13 is a two-dimensional diagram showing luminance distributions before and after correction at the highest gradation level of the liquid crystal display panel.
Figure 15:
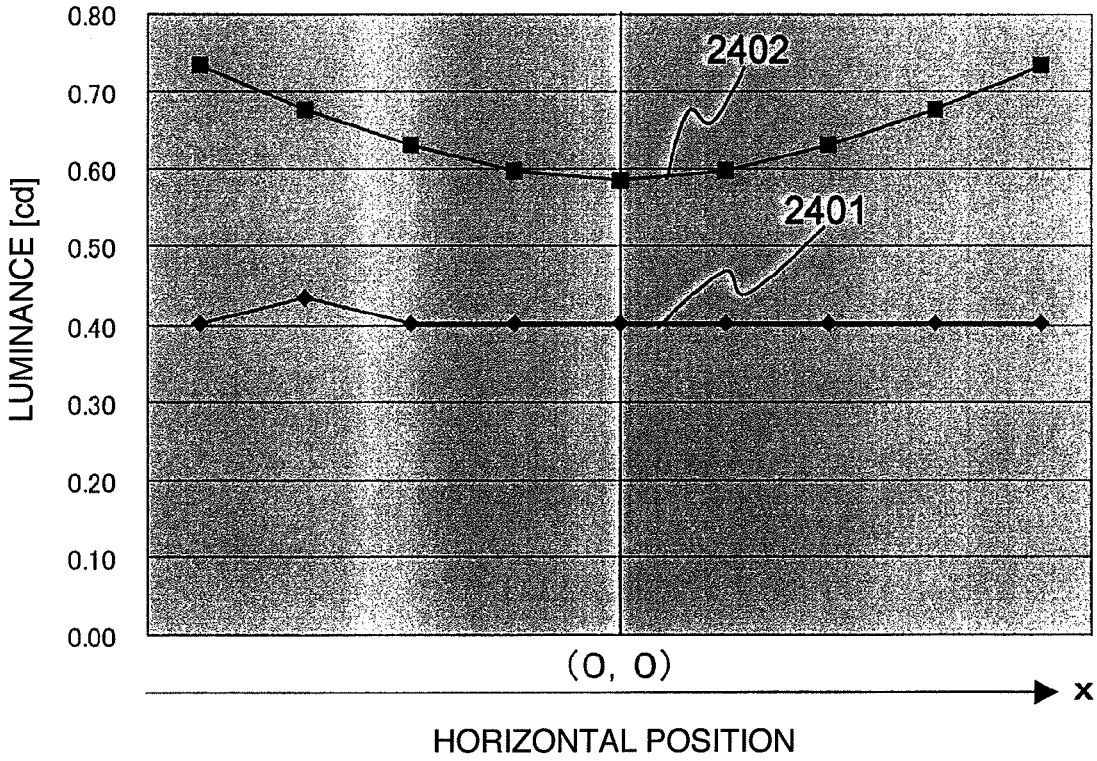
FIG. 15 is a two-dimensional diagram showing luminance distributions before and after correction at the lowest gradation level of the liquid crystal display panel.

Next, description will be made on the operation at Step 503 shown in FIG. 5. As an example, description will be made on a method of obtaining gradation data $G(g_{max}, 0, 0)$ and $G(g_{min}, 0, 0)$ at the center of the panel in the examples shown in FIGS. 12A and 12B and FIGS. 14A and 14B. FIG. 13 is a diagram obtained by cutting FIGS. 12A and 12B along an xz plane. The abscissa represents a position along the X-direction. A curve 2201 indicates a luminance at the highest gradation level $g_{max}$ measured at Step 206 in FIG. 2, and a curve 2202 indicates the target curved luminance plane $Bp(g_{max}, x, y)$ at the highest gradation level. FIG. 15 is a diagram obtained by cutting FIGS. 14A and 14B along an xz plane. The abscissa represents a position along the X-direction. A curve 2401 indicates a luminance at the lowest gradation level $g_{min}$ measured at Step 206 in FIG. 2, and a curve 2402 indicates the target curved luminance plane $Bp(g_{min}, x, y)$ at the lowest gradation level.

Generally, the gradation/luminance characteristics of a display are adjusted so as to follow a predetermined function. An adjustment method most frequently used follows generally the function of the following formula (10).

$$L(g)=Lg_{min}+(Lg_{max}-Lg_{min})\times(g/g_{max})^{2.2} \tag{10}$$

An inverse function of the formula (10) is the following formula (11). The gradation data G(g, x, y) on the XY coordinate system can be calculated by using the formula (11).

$$g = g_{max}\left(\frac{L(g) - Lg_{min}}{Lg_{max} - Lg_{min}}\right)^{\frac{1}{2.2}} \tag{11}$$

If a panel has the characteristics shown in FIGS. 13 and 15 and the gradation/luminance characteristics are adjusted to follow the function of the formula (10), the highest luminance $Lg_{max}$ is 225 cd at the position (0, 0) as shown in FIG. 13 and the lowest luminance $Lg_{min}$ is 0.4 cd at the position (0, 0) as shown in FIG. 15. Therefore, if the luminance at the highest gradation level of 255 is to be lowered to 213 cd in FIG. 13, the gradation data $G(g_{max}, 0, 0)$ of 249 at the highest gradation level can be obtained by solving the following formula (12). Similarly, gradation data at other reference points of the panel can be obtained.

$$G(g_{max}, x, y) = 255\times\left(\frac{213 - 0.4}{225 - 0.4}\right)^{\frac{1}{2.2}} \approx 249 \tag{12}$$

If the luminance at the lowest gradation level of 0 is to be raised to 0.59 cd in FIG. 15, the gradation data $G(g_{min}, 0, 0)$ of 10 at the lowest gradation level can be obtained by solving the following formula (13). Similarly, gradation data at other reference points of the panel can be obtained.

$$G(g_{min}, x, y) = 255\times\left(\frac{0.59 - 0.4}{225 - 0.4}\right)^{\frac{1}{2.2}} \approx 10 \tag{13}$$

Although the gradation/luminance characteristics are assumed to follow the formula (10) by way of example, the present invention is not limited thereto, but is applicable to any of gradation/luminance characteristics if an inverse function is used.

By using the gradation data G(g, x, y) calculated in the manner described above, coefficients of the Y-direction third-order interpolation curve shown in FIG. 5 are generated (Step 505). These coefficients are calculated by replacing B(g, x, y) for the XY coordinate system obtained by using the formulae (2), (3), (4) and (5) with G(g, x, y), and written in the nonvolatile memory 133 of the liquid crystal display device 100 (Step 506) to thereafter terminate the process at Step 209 for correction value calculation.

Figure 7:
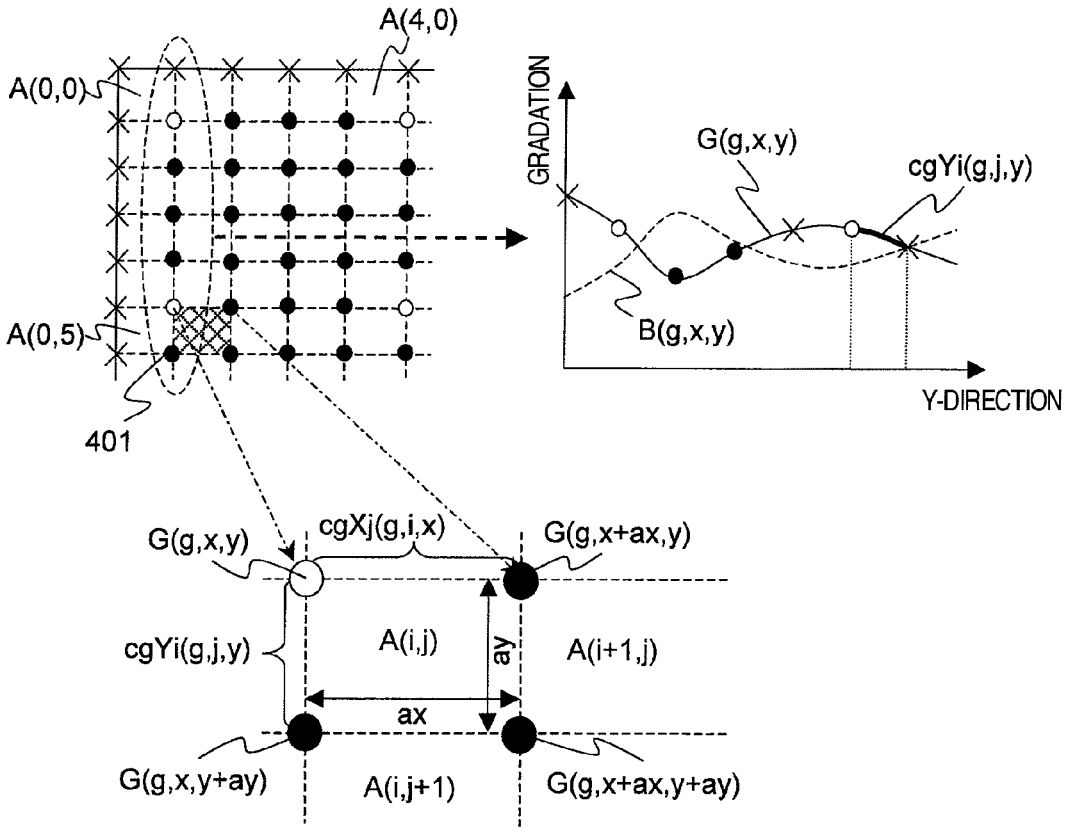
FIG. 7 illustrates a relation between interpolation gradation and interpolation areas.

Next, with reference to FIG. 7, description will be made on a process (Step 505) of generating coefficients of the Y-direction third-order interpolation curve from the gradation data G(g, x, y). Referring to FIG. 7, when a luminance variation is to be corrected, the panel is divided into each interpolation area A (i, j) having, for example, a detail reference point 401 as an apex and the number of horizontal pixels ax and vertical pixels ay. A point in the interpolation area is generated from a vertical direction interpolation curve cgYi(g, j, y) and a horizontal direction interpolation curve cgXj(g, i, x). The vertical direction interpolation curve cgYi(g, j, y) is expressed by the following formula (14).

$$cgY_i(g,j,y)=a(g,j)+b(g,j)(y-y_i)+c(g,j)(y-y_i)^2+d(g,j)(y-y_i)^3 \tag{14}$$

where g represents a gradation level such as g=0, 128, . . . , 255 and j represents the number of interpolation areas in the X-direction such as j=0, 1, 2, . . . , n.

Coefficients (parameters) of this formula (14) are calculated by a Sprine function interpolation method using the formulae (2), (3), (4) and (5). This calculation is executed at Step 501 shown in FIG. 5. The calculation results, only coefficients a(g, j), b(g, j), c(g, j) and d(g, j) for generating the gradation data G(g, x, y), are written in the nonvolatile memory 133 of the liquid crystal display panel 100.

Figure 8:
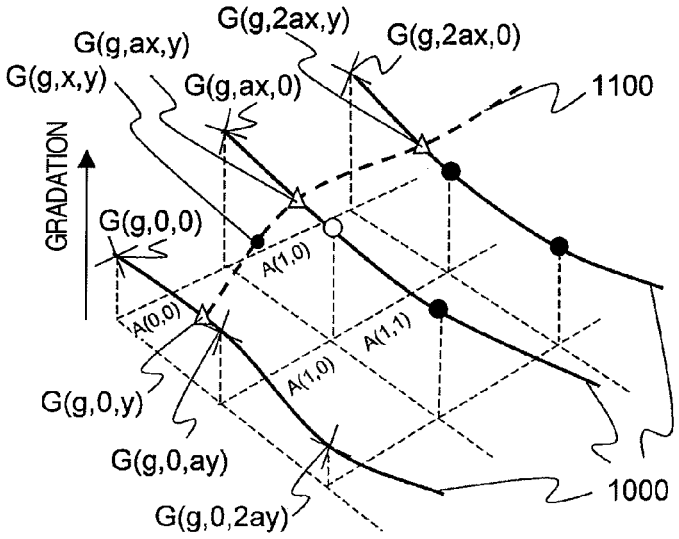
FIG. 8 is a diagram briefly illustrating an interpolation process to be executed in a liquid crystal display device.

Next, description will be made on the correction processing to be executed by the liquid crystal display device 100. As the liquid crystal panel 140 is activated, the image processing circuit 136 calculates the formula (14) to generate Y-direction third-order interpolation curves 1000 which interpolate luminances of pixels existing at the borders of the interpolation areas A(i, j) in the Y-direction, as shown in FIG. 8.

Next, while the y-coordinates are changed from y=0 to y=n, the gradation data G(g, x, y) at the border of the interpolation area A(i, j) including the y-coordinates at some timing is obtained by using the Y-direction third-order interpolation curve 1000, where x=0, ax, 2ax, . . . , n.

Next, in order to correct luminances in the X-direction, an X-direction third-order interpolation curve 1100 passing the gradation data G(g, x, y) in the Z-direction is generated. A Lagrange interpolation curve is used as the X-direction third-order interpolation curve cgXj(g, i, x). An equation of this curve is expressed by the following formula (15).

$$cgX_j(g,i,x)=a_jt+b_jt+c_jt^2+d_jt^3 \tag{15}$$

where $0\le t\le 3$. It is assumed that x=−ax at t=0, x=0 at t=1, x=ax at t=2, x=2ax at t=3, and that the formula (15) passes four points G(g, −ax, y), G(g, 0, y), G(g, ax, y) and G(g, 2ax, y). The coefficients aj, bj, cj and dj of this curve can be obtained from the following formulae (16).

$$a_j = G(g, -ax, y) \tag{16}$$

$$b_j = -\frac{11}{6}G(g, -ax, y) + 3G(g, 0, y) - \frac{3}{2}G(g, ax, y) + \frac{1}{3}G(g, 2ax, y)$$

$$c_j = G(g, -ax, y) - \frac{5}{2}G(g, 0, y) + 2G(g, ax, y) - \frac{G(g, 2ax, y)}{2}$$

$$d_j = -\frac{1}{6}G(g, -ax, y) + \frac{1}{2}G(g, 0, y) - \frac{1}{2}G(g, ax, y) + \frac{1}{6}G(g, 2ax, y)$$

Figure 9:
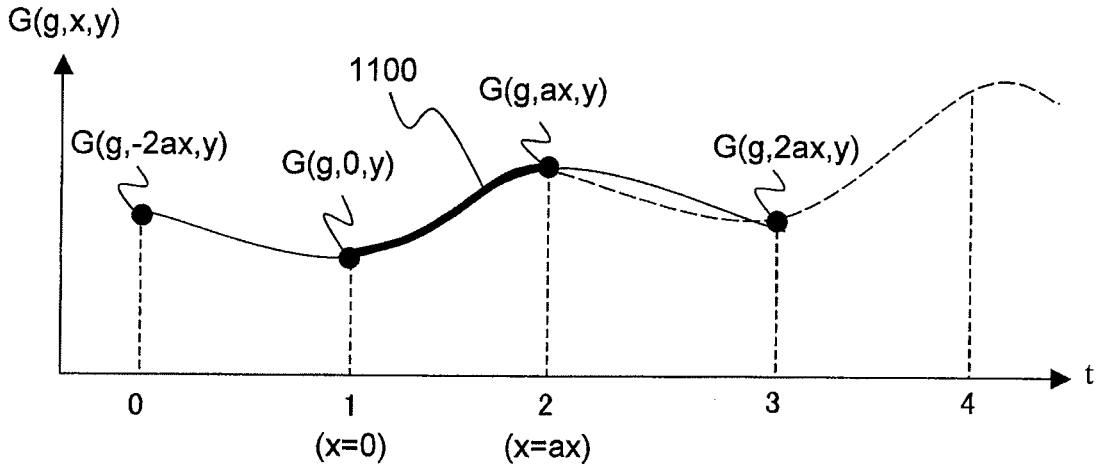
FIG. 9 is a schematic diagram showing a Lagrange curve used as an X-direction third-order interpolation curve.

As shown in FIG. 9, the values in the range of $1 \le t \le 2$ of the formulae (16) interpolate the gradation data G(g, x, y) in $0 \le x \le ax$ at specific y-coordinates in the interpolation area A(i, j), by using the third-order function. In this manner, gradation data for white luminance, black luminance and intermediate luminance is calculated at all gradation levels.

Figure 10:
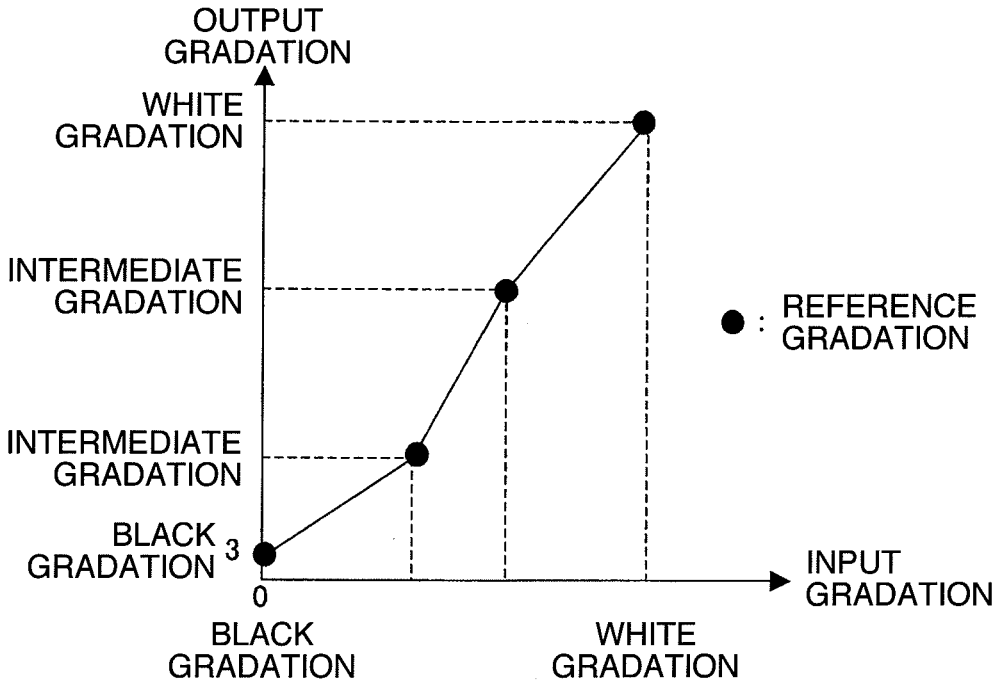
FIG. 10 is a diagram illustrating a gamma correction method.

Next, with reference to FIG. 10, description will be made on a method of performing line approximation gamma correction by using the gradation data G(g, x, y) as an output gradation. In the graph shown in FIG. 10 having an abscissa representing an input gradation and an ordinate representing an output gradation, for example, as an input black gradation of 0 is given, an output gradation of 3 is output as a conversion result. For an input gradation whose output gradation is still not calculated, the output gradation is calculated by linear interpolation.

Description has been made on the details of the luminance variation correction process of the liquid crystal display device. As the timing when gamma correction is calculated, gamma correction may be performed each time an output gradation corresponding to each pixel is obtained from the X-direction third-order interpolation curve 1100.

Figure 11:
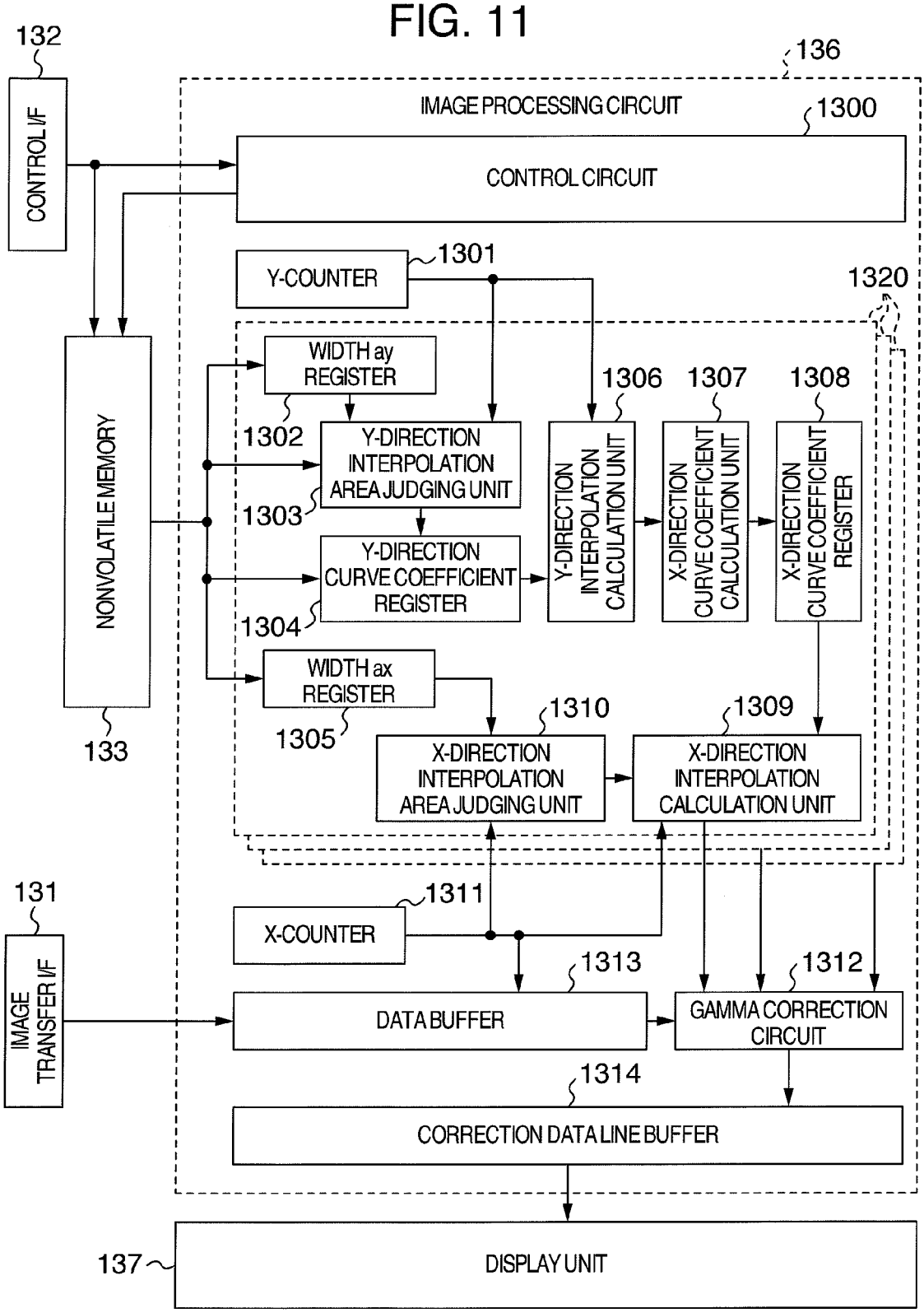
FIG. 11 is a diagram showing the details of the structure of an image processing circuit.

FIG. 11 is a diagram showing the details of the structure of the image processing circuit 136 of the liquid crystal panel unit 130. Referring to FIG. 11, a control circuit 1300 controls each module of the image processing circuit 136. Main operations include initialization of each circuit when the liquid crystal panel unit 130 is activated, various processes (such as display mode switching and correction function ON/OFF) corresponding to a control signal input via the control I/F 132, and display control typically the luminance variation correction process during the image display.

A Y counter 1301 indicates a Y-coordinate under processing. Namely, it indicates which horizontal scan line is processed. Each time one line is processed, the counter is counted up, and when a count takes m, it is cleared to 0 next time.

An interpolation gradation g generator circuit 1320 is a circuit for obtaining a correction value at a gradation level g by the method described above. This circuit is provided as many as the number of gradation levels for correction. Namely, if correction is performed for white, black and intermediate luminances at three gradation levels, three circuits 1320 are used and operated in parallel. This circuit reads information from the nonvolatile memory 133 when necessary.

A width ay register 1302 stores the number of vertical pixels ay in the area A(i, j) shown in FIG. 7. The value ay is read from the nonvolatile memory 133 into the register 1302 when the image processing circuit 136 is activated.

A Y-direction interpolation area judging unit 1303 judges from the y-coordinate a corresponding interpolation area A(i, j), reads from the nonvolatile memory 133 the Y-direction third-order interpolation curve generating coefficients a(g, j), b(g, j), c(g, j) and d(g, j) of the interpolation area, and sets the coordinates to a Y-direction curve coefficient register 1304.

A Y-direction interpolation calculation unit 1306 reads the coefficients of the third-order interpolation curve from the Y-direction curve coefficient register 1304 and the present Y-coordinate from the Y counter 1301, and calculates interpolation gradation at the present Y-coordinate.

An X-direction curve coefficient calculation unit 1307 reads the values calculated by the Y-direction interpolation calculation unit 1306, calculates coefficients of the X-direction third-order interpolation curve, and sets the calculation results to an X-direction curve coefficient register 1308.

Similar to the width ay register 1302, a width ax register 1305 stores the number of horizontal pixels ax of the area A(i, j) shown in FIG. 7. An X counter 1311 indicates an X-coordinate under processing and takes a value of 0 to n. Each time the Y counter 1301 is counted up and the line is changed, the counter is cleared.

An X-direction interpolation area judging unit 1310 judges a present interpolation area A(i, j) from the width ax register 1305 and X counter 1311, and notifies the X-direction third-order interpolation calculation unit 1309 of the coefficients to be read from an X-direction curve coefficient register 1308.

An X-direction interpolation calculation unit 1309 calculates sequentially interpolation gradation of each pixel in the X-direction (horizontal scan line direction) by using the X-direction third-order interpolation curve formula (15). The calculation results are input to the gamma correction circuit 1312.

Display image data is transferred via the image transfer I/F 131 to a data buffer 1313 and stored therein. Pixel data corresponding to a count of the X counter 1311 is read from the buffer 1313, and input to a gamma correction circuit 1312. The gamma correction circuit 1312 calculates an output gradation for the input gradation of the input pixel data, and outputs the calculation result to a correction data line buffer 1314. As pixel data of one line is accumulated in this buffer 1314, the pixel data is transmitted to the display unit 137 and displayed.

[Second Embodiment]

In the first embodiment, the measuring apparatus 102 performs a process of raising the luminance at the center of the panel higher than a periphery luminance at the highest gradation level and lowering the luminance at the center of the panel lower than the periphery luminance at the lowest gradation level, in order to improve contrast. In the second embodiment, this process of improving contrast is performed by the liquid crystal display device 100.

In the following, only different points from the first embodiment will be described.

Figure 16:
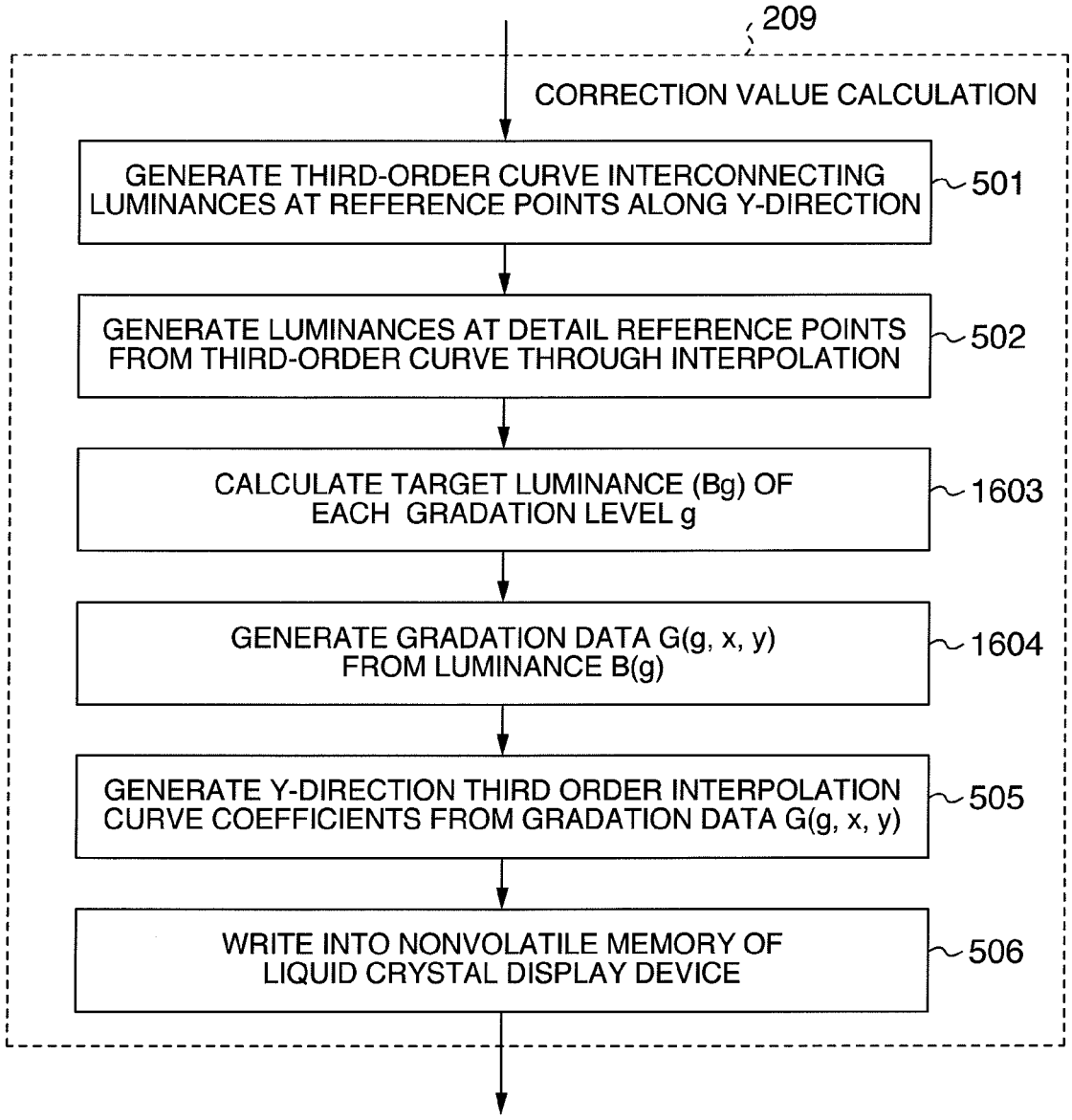
FIG. 16 is a flow chart illustrating another correction value calculation to be executed by the measuring apparatus.

FIG. 16 is a flow chart illustrating the detailed process of correction value calculation at 209 shown in FIG. 2. FIG. 16 corresponds to FIG. 5 in the first embodiment. Steps 503 and 504 of FIG. 5 are changed to Steps 1603 and 1604 in the second embodiment. In the first embodiment, after the interpolation luminances at the detail reference points 401 are generated, the target curved luminance plane is generated to raise the luminance at the center of the panel at the highest gradation level and lower the luminance at the center of the panel at the lowest gradation level.

Figure 17:
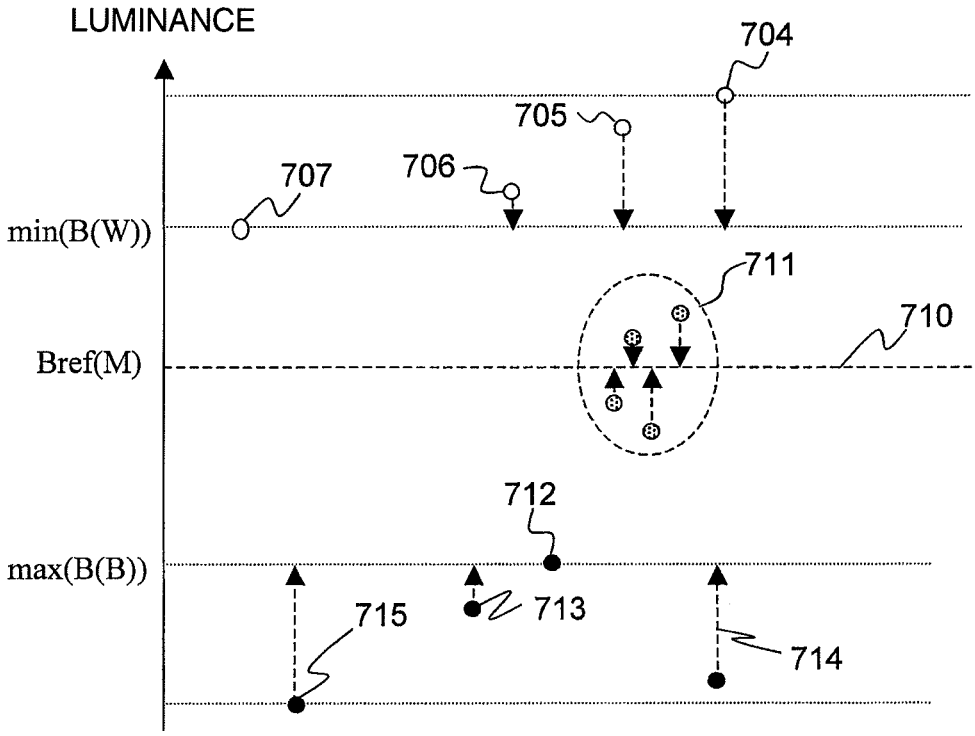
FIG. 17 is a diagram illustrating luminance suppression at each position.

However, in the second embodiment, as shown in FIG. 17, a target luminance value at the highest gradation level is set uniformly to a luminance value min(B(W)) which is the lowest measured luminance value 707 among measured luminance values 704 to 707 at the highest gradation level, and a target luminance value at the lowest gradation level is set uniformly to a luminance value max(B(B)) which is the highest measured luminance value 712 among measured luminance values 712 to 715 at the lowest gradation level. Namely, it is set that $B(g_{max})=\min(B(W))$ and $B(g_{min})=\max(B(B))$ (Step 1603, Step 1604). Therefore, the measuring apparatus 102 supplies the liquid crystal display device 100 with final correction values including the display luminance of min(B(W)) uniform over the whole panel at the highest gradation level and the display luminance of max(B(B)) uniform over the whole panel at the lowest gradation level. Measured luminance values 711 at an intermediate gradation level may be set uniformly to a luminance Bref(M) which is a target luminance 710 at the intermediate gradation level.

Figure 18:
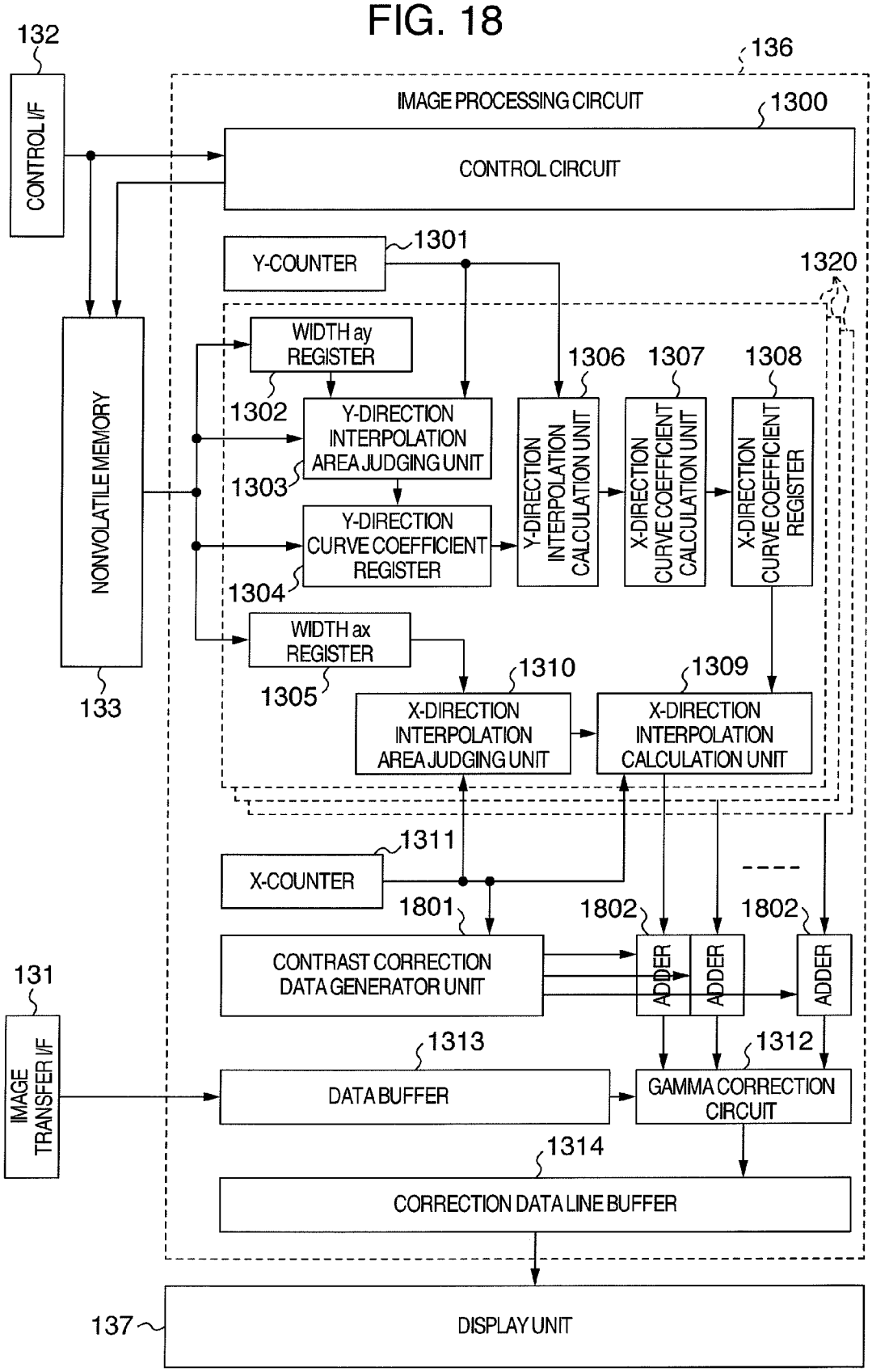
FIG. 18 is a diagram showing the details of the structure of another image processing circuit.

FIG. 18 is a diagram showing the details of the image processing circuit 136 of the liquid crystal display unit 130 of the second embodiment. In this embodiment, a contrast correction data generator unit 1801 and adder circuits 1802 are added to the first embodiment. The contract correction data generator unit 1801 generates and outputs each gradation level and contrast correction data Gc(g, x, y) corresponding to the x- and y-coordinates of the panel under processing. In this case, the contrast correction data is generated to take a minimum negative value at the center of the panel at the lowest gradation level, and a maximum positive value at the center of the panel at the highest gradation level. A function giving these values is, e.g., the following formula (17).

$$Gc(g,x,y)=Ac(g)\times\mathrm{COS}(\pi x/(2x_{max}))\mathrm{COS}(\pi y/(2y_{max}))) \quad (17)$$

where x and y represent a position on the panel having an origin (0, 0) as the center of the panel, xmax and ymax represent the maximum values of x and y, with the origin (0, 0) being used as the center of the panel. Ac(g) represents a function of a gradation level g, and takes a negative value at the lowest gradation level and a positive value at the highest gradation level.

The contrast correction values generated in the manner described above are added at the adders 1802 so that a value lower than the target luminance value can be given at the center of the panel at the lowest gradation level and a value higher than the target luminance value can be given at the highest gradation level. Also in this case, Ac(g) is set so that a ratio between the minimum luminance value $B_{min}(g_{max})$ and maximum luminance value $B_{max}(g_{max})$ after correction at the highest gradation level becomes not smaller than $\mathrm{Buni}(g_{max})$, and a ratio between the minimum luminance value $B_{min}(g_{min})$ and maximum luminance value $B_{max}(g_{min})$ after correction at the lowest gradation level becomes not smaller than $\mathrm{Buni}(g_{min})$. Also in this embodiment, it is possible to obtain high contrast and maintain a high image quality after correction, without displaying stripes and the like because of smooth luminance change.

In the two embodiments described above, the display unit 137 may be other display devices such as an organic EL panel. As the third-order curve for in-plane luminance variation correction, functions other than the Sprine function and Lagrange function may also be used. With this configuration, it is also possible to obtain high contrast and maintain a high image quality after correction, without displaying stripes and the like because of smooth luminance change.

The correction timing may be when the panel is shipped from a panel maker or when the panel is assembled in a housing at a display maker. The luminance unevenness of the liquid crystal display panel varies at all times because of a secular change during usage by a user, a room temperature change, a temperature change by heat of a backlight during used and the like.

In the first and second embodiments, the measuring apparatus 102 and image sensor 101 are used under various conditions. For example, when a liquid crystal display panel is shipped from a factory, a measuring apparatus 102 and image sensor 101 prepared specifically by the panel maker may be used. In the inspection before shipping and after assembly at a display maker, an inspection system of the display maker loading a portion of software of the panel maker may also be used. In the inspection during usage by a user, the measuring apparatus 102 and image sensor 101 may be a luminance meter and the like connectable to a standard input/output unit of a personal computer (PC) of a user. In this case, software loaded in CD appended to the liquid crystal display panel realizes the functions of the measuring apparatus 102 on the user PC to calculate setting values when the liquid crystal display panel is activated and to rewrite the nonvolatile memory 133.

The software on PC may automatically perform measurements and correction calculations at a constant time interval, and rewrite the nonvolatile memory 133 via the control interfaces 109 and 132. With this procedure, the present invention can deal with a change in the characteristics after sealing a panel in the housing at a display maker, a color change due to a secular change, a luminance change by a temperature and the like.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. An image correction method wherein:

a display area of a display panel is divided into a plurality of areas, cross points between border lines of the plurality of areas are defined as reference points, a luminance only at each reference point is measured, a luminance at a point still not measured is calculated from the luminances only at the reference points, by interpolation;

wherein, as said interpolation, an interpolation method that uses a third-order Spline curve is used;

wherein said interpolation is such that a first interpolation is calculated in a first direction and, by using a result of the first interpolation calculation, an interpolation calculation is made in a direction perpendicular to the first direction, so that the luminances are obtained for the entire display panel, wherein in accordance with the luminance at each point still not measured and the luminance at each reference point, when a luminance data at a highest gradation level is input to the display panel, a display luminance on the display panel is corrected;

correction of the display luminance on the display panel is performed in such a manner that a distribution of the display luminance forms a curved plane taking a highest luminance at a center of the display panel and a lowest luminance at a periphery of the display panel;

wherein in accordance with luminance at each point still not measured and the luminance at each reference point, when a luminance data at a lowest gradation level is input to the display panel, a display luminance on the display panel is corrected;

correction of the display luminance on the display panel is performed in such a manner that a distribution of the display luminance forms a curved plane taking a lowest luminance at a center of the display panel and a highest luminance at a periphery of the display panel;

wherein the curve of the distribution of the display luminance when the luminance data at the highest gradation level is input to the display panel and when the luminance data at the lowest gradation is input to the display panel are similarly shaped and opposite one another in regards to the horizontal axis.

2. The image correction method according to claim 1, wherein said curved plane has a ratio between a lowest display luminance and a highest display luminance, not smaller than 0.85 and not larger than 1.

3. The image correction method according to claim 1, wherein said correction is performed when the display panel is shipped, when the display panel is assembled, or when the display panel is in use.

4. The image correction method according to claim 1, wherein said curved plane has a ratio between a lowest display luminance and a highest display luminance, not smaller than 0.6 and not larger than 1.

5. The image correction method according to claim 1, wherein said correction is performed when the display panel is shipped, when the display panel is assembled, or when the display panel is in use.

6. An image display apparatus comprising:

a display panel having a display area divided into a plurality of areas, cross points between border lines of the plurality of areas being defined as reference points; and an image processing circuit for correcting display luminances in accordance with measured luminances a luminance only at each reference point and luminances at each point still not measured and calculated from the luminances only at the reference points, by interpolation, wherein correction of by said image processing circuit is performed in such a manner that the display luminances are smooth from a center of the display panel to a periphery of the display panel, wherein the luminance at a highest graduation level is higher at a center of the display panel than the luminance at a periphery of the display panel and the luminance at a lowest graduation level is lower at the center of the display panel than the luminance at the periphery of the display panel, wherein, as said interpolation, an interpolation method that uses a third-order Spline curve is used;

wherein said interpolation is such that a first interpolation is calculated in a first direction and, by using a result of the first interpolation calculation, an interpolation calculation is made in a direction perpendicular to the first direction, so that the luminances are obtained for the entire display panel, wherein in accordance with the luminance at each point still not measured and the luminance at each reference point, when a luminance data at a highest gradation level is input to the display panel, a display luminance on the display panel is corrected;

correction of the display luminance on the display panel is performed in such a manner that a distribution of the display luminance forms a curved plane taking a highest luminance at a center of the display panel and a lowest luminance at a periphery of the display panel;

wherein in accordance with luminance at each point still not measured and the luminance at each reference point, when a luminance data at a lowest gradation level is input to the display panel, a display luminance on the display panel is corrected;

correction of the display luminance on the display panel is performed in such a manner that a distribution of the display luminance forms a curved plane taking a lowest luminance at a center of the display panel and a highest luminance at a periphery of the display panel;

wherein the curve of the distribution of the display luminance when the luminance data at the highest gradation level is input to the display panel and when the luminance data at the lowest gradation is input to the display panel are similarly shaped and opposite one another in regards to the horizontal axis.

7. An image display apparatus comprising:

a display panel having a display area divided into a plurality of areas, cross points between border lines of the plurality of areas being defined as reference points; and an image processing circuit for correcting display luminances in accordance with measured luminances a luminance only at each reference point and luminances at each point still not measured and calculated from the luminances only at the reference points, by interpolation, wherein said image processing circuit corrects in a manner that the display luminances become gradually high or low from a center of the display panel to a periphery of the display panel, wherein the luminance at a highest graduation level is higher at a center of the display panel than the luminance at a periphery of the display panel and the luminance at a lowest graduation level is lower at the center of the display panel than the luminance at the periphery of the display panel, wherein, as said interpolation, as interpolation method that uses a third-order Spline curve is used;

wherein said interpolation is such that a first interpolation is calculated in a first direction and, by using a result of the first interpolation calculation, an interpolation calculation is made in a direction perpendicular to the first direction, so that the luminances are obtained for the entire display panel, wherein in accordance with the luminance at each point still not measured and the luminance at each reference point, when a luminance data at a highest gradation level is input to the display panel, a display luminance on the display panel is corrected;

correction of the display luminance on the display panel is performed in such a manner that a distribution of the display luminance forms a curved plane taking a highest luminance at a center of the display panel and a lowest luminance at a periphery of the display panel;

wherein in accordance with luminance at each point still not measured and the luminance at each reference point, when a luminance data at a lowest gradation level is input to the display panel, a display luminance on the display panel is corrected;

correction of the display luminance on the display panel is performed in such a manner that a distribution of the display luminance forms a curved plane taking a lowest luminance at a center of the display panel and a highest luminance at a periphery of the display panel;

wherein the curve of the distribution of the display luminance when the luminance data at the highest gradation level is input to the display panel and when the luminance data at the lowest gradation is input to the display panel are similarly shaped and opposite one another in regards to the horizontal axis.

8. The image correction method according to claim 1, wherein the target luminance of each intermediate gradation data of reference point is calculated from the luminances of the maximum gradation level and minimum gradation level of the reference position.

9. The image display apparatus according to claim 6, wherein the target luminance of each intermediate gradation data of reference point is calculated from the luminances of the maximum gradation level and minimum gradation level of the reference position.

10. The image display apparatus according to claim 7, wherein the target luminance of each intermediate gradation data of reference point is calculated from the luminances of the maximum gradation level and minimum gradation level of the reference position.

* * * * *